United States Patent [19]

Nitta

[11] Patent Number: 4,859,172

[45] Date of Patent: Aug. 22, 1989

[54] PIEZOELECTRIC LIGHTER EQUIPPED WITH A SAFETY LOCK

[75] Inventor: Tomio Nitta, Yokohama, Japan

[73] Assignee: Tokai Corporation, Yokohama, Japan

[21] Appl. No.: 196,171

[22] Filed: May 17, 1988

[30] Foreign Application Priority Data

May 20, 1987 [JP] Japan ..... 62-74371[U]

[51] Int. Cl.[4] ..... F23D 11/36

[52] U.S. Cl. ..... 431/153; 431/255

[58] Field of Search ..... 431/255, 153

[56] References Cited

U.S. PATENT DOCUMENTS 4,487,570 12/1984 Lowenthal ..... 431/153

4,786,248 11/1988 Nitta ..... 431/255

*Primary Examiner*—Carroll B. Dority, Jr.

*Attorney, Agent, or Firm*—Armstrong, Nikaido, Marmelstein, Kubovcik & Murray

[57] ABSTRACT

Piezoelectric lighter equipped with a rotatable hook-shaped safety lock is composed of a shank, a finger catch fixed to one end of the shank, a pivot fixed to the other end of the shank, a catch plate fixed to the pivot at the side opposite to the shank and extending substantially perpendicular to the shank, the catch plate having a longitudinal size larger than the width of the slot of a push cap which is put on a piezoelectric unit and a lateral size smaller than the width of the slot of the push cap. The safety lock is rotatably fixed on the top raised side of the casing at such a position that the catch plate may prevent the push cap from descending when the safety lock is put in its locking position in which the shank is vertical with the catch plate laid horizontal and at such a position that the catch plate may allow the push cap to descend when the safety lock is put in its unlocking position in which the shank is horizontal with the catch plate laid vertical.

3 Claims, 2 Drawing Sheets

PIEZOELECTRIC LIGHTER EQUIPPED WITH A SAFETY LOCK

BACKGROUND OF THE INVENTION

1. Field of the Invention

The present invention relates to a piezoelectric lighter equipped with a safety lock. Such a lighter will be put in inoperative position when locked with its safety lock.

2. Related Art

A conventional piezoelectric lighter is designed so that a thumb push to its operating cap may cause ejection of flammable gas from its nozzle and at the same time, appearance of spark across the gas from the nozzle, thereby causing a small flame to shoot upward. Such a lighter can be used even by a child, and therefore there is a fear that a fire may take place or the child may burn for instance, it's hand while playing with the lighter.

With this in mind, the object of the present invention is to provide a piezoelectric lighter equipped with a safety lock which is simple in structure and easy to use, still ensuring prevention of accidental fire or burn on one's body.

SUMMARY OF THE INVENTION

To attain this object, a piezoelectric lighter comprising a casing, a gas ejection nozzle appearing from the ceiling of the casing; a windshield fixed to the ceiling of the casing and encircling the gas ejection nozzle, a piezoelectric unit fitted in the casing, a thumb-operated push cap operatively connected both to the gas ejection nozzle and to the piezoelectric unit for striking spark in response to a push to the push cap, and a liquefied gas cell defined in the casing and communicating with the gas ejection nozzle, is improved according to the present invention in that the thumb-operated push cap has a slot made on its outer surface and that it further comprises a rotatable hook-shaped safety lock, which is composed of a shank, a finger catch fixed to one end of the shank, a pivot fixed to the other end of the shank, a catch plate fixed to the pivot at the side opposite to the shank and extending substantially perpendicular to the shank, the catch plate having a longitudinal size larger than the width of the slot of the push cap and a lateral size smaller than the width of the slot of the push cap, the safety lock being rotatably fixed to the top raised side of the casing at such a position that the catch plate may prevent the push cap from descending when the safety lock is put in its locking position in which the shank is vertical with the catch plate laid horizontal and at such a position that the catch plate may allow the push cap to descend when the safety lock is put in its unlocking position in which the shank is horizontal with the catch plate laid vertical.

In operation when the rotatable hook-shaped safety lock is rotated to the locking position in which its shank is vertical with its catch plate laid horizontal, thereby causing the slot of the push cap to prevent the push cap from descending to strike fire, whereas when the rotatable hook-shaped safety lock is rotated to the unlocking position in which its shank is horizontal with its catch plate laid vertical, thereby allowing the catch plate to slide in the slot of the push cap to allow the push cap to descend and strike fire.

Other objects and advantages of the present invention will be better understood from the following description of a piezoelectric lighter according to a preferred embodiment of the present invention, which is shown in accompanying drawings.

PREFERRED EMBODIMENT

Figure 1:
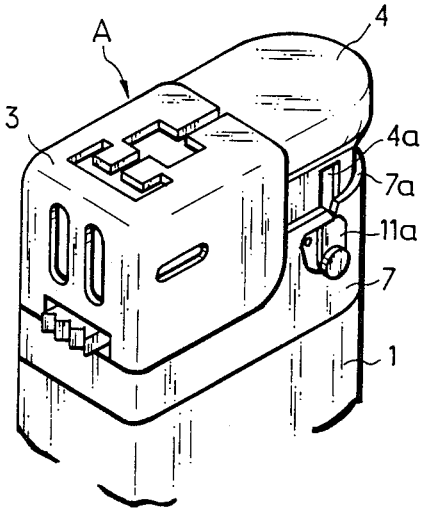
FIG. 1 is a perspective view showing the top of a piezoelectric lighter according to a preferred embodiment of the present invention.

Referring to the drawings, a piezoelectric lighter according to a preferred embodiment of the present invention is indicated at "A".

The piezoelectric type is shown as comprising a casing 1, a gas ejection nozzle 2 appearing from the ceiling of the casing, a windshield 3 fixed to the ceiling of the casing and encircling the gas ejection nozzle 2, a piezoelectric unit 8 fitted in the casing, a thumb-operated push cap 4 operatively connected both to the gas ejection nozzle and to the piezoelectric unit for striking spark in response to a push to the push cap, and a liquefied gas cell 5 defined in the casing and communication with the gas ejection nozzle.

The liquefied gas cell 5 is closed with its cap member 6, and a piezoelectric unit casing 7 with a raised top side is fitted in the cap member 6, and is connected to the casing 1. As shown, the piezoelectric unit 8 is fitted in the casing 7 exposing its top portion above the casing 7. The thumb-operated push cap 4 is attached to the to of the piezoelectric unit 8. It is vertically movable, and is spring-biased upwards. When pushed down with thumb, the push cap 4 will be yeildingly lowered to subject the piezoelectric unit 8 to a strike for generating between its terminals 9 and 10 a voltage high enough to cause an electric spark in the vicinity of the gas ejecting nozzle 2.

The push cap 4 has a slot **4*a* made on its outer surface. A rotatable hook-shaped safety lock 11 is composed of a shank 11*a*, a finger catch 111*a* fixed to one end of the shank, a pivot 11*c* fixed to the other end of the shank, a catch plate 11*b* fixed to the pivot at the side opposite to the shank 11*a* and extending substantially perpendicular to the shank 11*a*. The catch plate 11*b* has a longitudinal size larger than the width of the slot 4*a* of the push cap 4 and a lateral size smaller than the width of the slot 4*a* of the push cap. The safety lock 11 is rotatably fixed to the top raised side 7*a*** of the casing.

Figure 2:
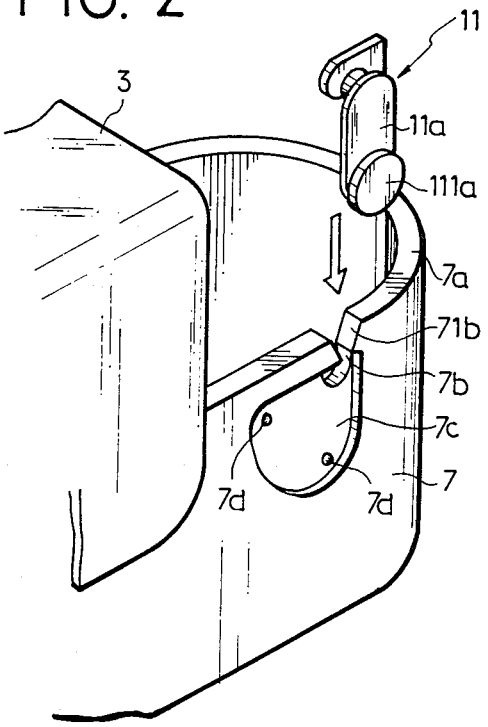
FIGS. 2 and 3 show how a safety lock is attached to the lighter body.
Figure 3:
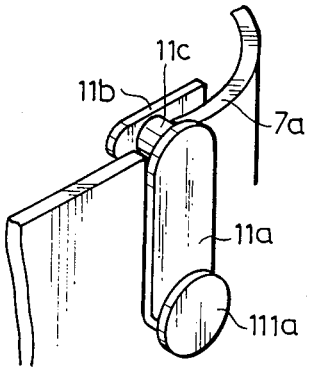
Figure 4:
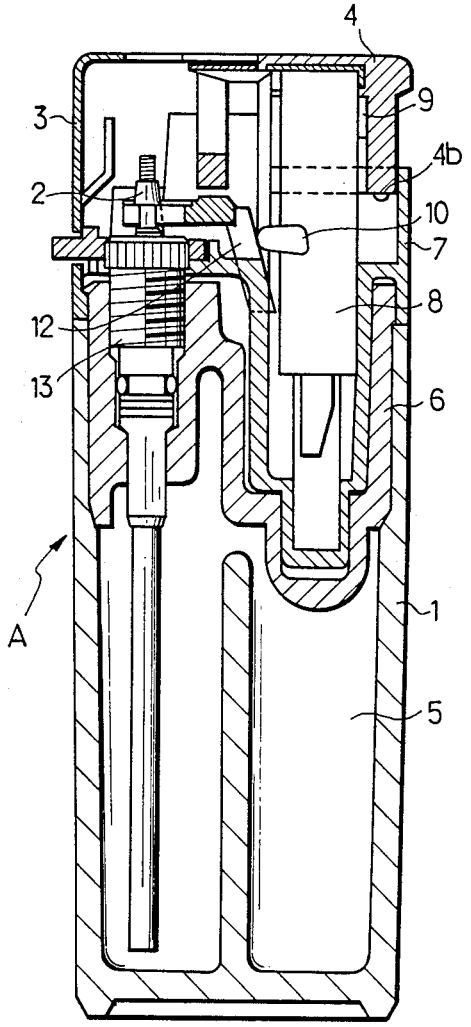
FIG. 4 is a longitudinal section of the lighter.

Specifically, the top raised side **7*a* has a V-and-circular shaped notch 71*b* and 7*b* at a position corresponding to the slot 4*a* of the push cap 4, as best seen from FIG. 2. The channel connecting the open pointed end of the V-notch 71*b* to the circular hole 7*b* is somewhat narrower than the diameter of the pivot 11*c*. When the pivot 11*c* is pushed in the channel, it yieldingly expands wide enough to allow the pivot 11*c* to snap in the circular hole 7*b*. When the pivot 11*c* has snapped in the circular hole 7*b*, the channel resiliently returns to its original size, thereby preventing the pivot 11*c*** from slipping off from the circular hole.

Thus, the hook-shaped safety lock 11 is rotatably fixed to the raised side of the piezoelectric unit casing with its catch plate 11*b* and shank 11*a* inside and out respectively. Preferably, a sector indentation 7*c* is made in the outer surface of the casing at a position which is contiguous to the V-and-circular hole 71*b* and 7*b*. The sector indentation 7*c* is deep enough for the shank 11*a* to be flush with the casing surface, thereby allowing the finger catch 111*a* of the safety lock 11 to appear on the casing surface. Two semispherical projections 7*d* are about 90 degrees apart from each other in the sector indentation 7*c*, and the shank 11*a* of the safety lock 11 has a small semispherical blind hole, although not seen from the drawings.

Figure 5:
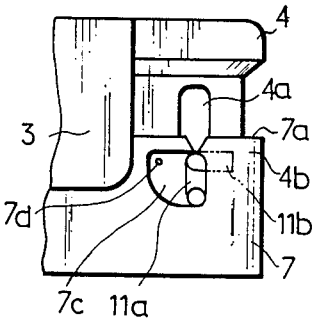
FIG. 5 shows schematically the position in which the lighter is locked.
Figure 6:
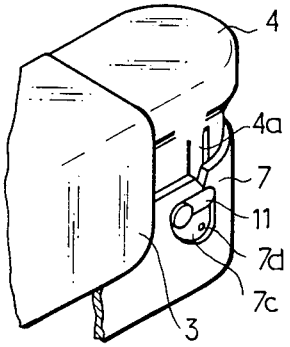
FIGS. 6 to 8 show schematically the position in which the lighter is unlocked.
Figure 7:
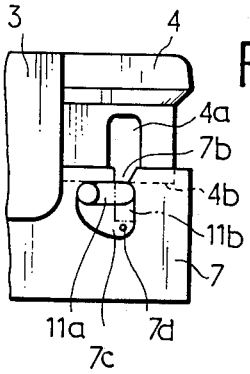
Figure 8:
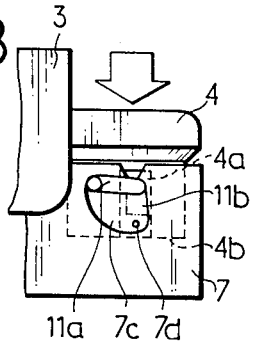

One of these projections 7*d* may snap in the blind hole of the shank 11*a* of the safety lock 11 when the safety lock 11 is put in its locking position in which the shank 11*a* is vertical with the catch plate 11*b* laid horizontal, thereby catching the slot 4*a* of the push cap 4 to prevent the push cap 4 from descending (See FIGS. 1 and 5) whereas the other projection may snap in the blind hole of the shank 11*a* of the safety lock 11 when the safety lock 11 is put in its unlocking position in which the shank is horizontal with the catch plate laid vertical, thereby allowing the catch plate 11*b* to slide in the slot 4*a* of the push cap 4 to permit the push cap 4 to descend (See FIGS. 6, 7 and 8).

In the locking position the shank 11*a* is held vertical with its blind hole caught by the lower semispherical projection. Likewise, in its unlocking position the shank 11*a* is horizontal with its blind hole caught by the upper semispherical projection.

The safety lock can be easily moved with thumb to select one of the two stable positions. It should be, however, noted that thanks to the gravity of the shank's weight, the selection of the vertical, locking position requires a force less than that which is required for selecting the horizontal, unlocking position. This and the natural, vertical posture of the shank of the safety lock in its locking position, together, would increase the probability with which the lighter is put in its locking position, compared with the probability with which the lighter is put in it unlocking position. Thus, this arrangement has an effect on prevention of accidental fire or burn on one's body, which would be caused by inadvertent unlocking of the lighter.

What is claimed is:

1. A piezoelectric lighter comprising: a casing; a gas ejection nozzle appearing from a ceiling of the casing; a windshield fixed to the ceiling of the casing and encircling the gas ejection nozzle; a piezoelectric unit fitted in the casing; a thumb-operated push cap operatively connected both to the gas ejection nozzle and to the piezoelectric unit for striking spark in response to a push to the push cap; and a liquefied gas cell defined in the casing and communicating with the gas ejection nozzle, characterized in that the thumb-operated push cap has a slot made on its outer surface and that it further comprises a rotatable hook-shaped safety lock, which is composed of a shank, a finger catch fixed to one end of the shank, a pivot fixed to the other end of the shank, a catch plate fixed to the pivot at the side opposite to the shank and extending substantially perpendicular to the shank, the catch plate having a longitudinal size larger than the width of the slot of the push cap and a lateral size smaller than the width of the slot of the push cap, the safety lock being rotatably fixed to a top raised side of the casing at such a position that the catch plate may prevent the push cap from descending when the safety lock is put in its locking position in which the shank is vertical with the catch plate laid horizontal and at such a position that the catch plate may allow the push cap to descend when the safety lock is put in its unlocking position in which the shank is horizontal with the catch plate laid vertical.

2. A peizoelectric lighter as claimed in claim 1, wherein the casing has two small semispherical projections on its outer surface, and the shank of the safety lock has a small blind hole, the two projections being positioned so that one of these projections may snap in the blind hole of the shank of the safety lock when the safety lock is put in its locking position and so that the other projection may snap in the blind hole of the shank of the safety lock when the safety lock is put in its unlocking position.

3. A piezoelectric lighter as claimed in claim 2, wherein the casing has a notch made on the raised side of the casing for bearing the pivot of the safety lock, and a sector indentation made in its outer surface, the sector indentation being deep enough for the shank of the safety lock to be flush with the casing surface, allowing the finger catch of the safety lock to appear on the casing surface, the two projections being about 90 degrees apart from each other in the sector indentation.

* * * * *